United States Patent [19]

Taylor

[11] 4,180,027

[45] Dec. 25, 1979

[54] TWO-PIECE OIL-COOLED PISTON

[75] Inventor: Joe N. Taylor, Mercersburg, Pa.

[73] Assignee: Mack Trucks, Inc., Allentown, Pa.

[21] Appl. No.: 817,348

[22] Filed: Jul. 20, 1977

[51] Int. Cl.[2] ..... F01P 3/06; F01P 3/10

[52] U.S. Cl. ..... 123/41.35; 123/41.34; 123/41.36; 123/193 P; 92/186; 92/216

[58] Field of Search ..... 123/41.31, 41.33, 41.34, 123/41.35, 41.36, 41.37, 41.38, 41.39, 193 CP, 193 P; 92/186, 216, 219, 224, 228, 190

[56] References Cited

U.S. PATENT DOCUMENTS

| | | | |
|---|---|---|---|
| 2,759,461 | 8/1956 | Maybach et al. | 123/41.35 |
| 2,815,011 | 12/1957 | Holt | 123/41.38 |
| 2,819,936 | 1/1958 | Cambeis | 92/186 |
| 3,336,844 | 8/1967 | Cornet | 92/186 |
| 3,613,521 | 10/1971 | Itano | 123/41.38 |
| 3,805,677 | 4/1974 | Clary et al. | 92/186 |
| 4,056,044 | 11/1977 | Kamman et al. | 123/41.35 |
| 4,073,220 | 2/1978 | Guenther | 92/219 |
| 4,114,519 | 9/1978 | Speaight | 92/186 |

*Primary Examiner*—Charles J. Myhre
*Assistant Examiner*—Jeffrey L. Yates
*Attorney, Agent, or Firm*—Bernard & Brown

[57] ABSTRACT

A two-piece piston includes head and skirt sections having opposed annular recesses to define a continuous peripheral coolant chamber. A transverse coolant conveying channel communicating at opposite ends with the chamber may also be formed in the skirt section to provide cooling for the central portion of the piston crown.

22 Claims, 6 Drawing Figures

TWO-PIECE OIL-COOLED PISTON

BACKGROUND OF THE INVENTION

The present invention is an improved piston for use in internal combustion engines, especially of the diesel type. Of all engine components, the piston is one of the most severely loaded, both mechanically and thermally. In the design of a more durable engine, it is therefore desirable to provide a piston which incorporates an improved means for cooling the piston head without sacrificing the strength needed to endure the high mechanical stresses incident to combustion. It is also desirable to provide an economical yet reliable design from a manufacturing standpoint.

Pistons have been designed in the past to provide a cooling fluid to the underside of the piston head, thus partially relieving the problem of thermal stress. One such design is that disclosed in U.S. Pat. No. 3,336,844 to Cornet, in which a multi-component piston is provided with an interior fluid-carrying trough. The trough collects, for recycling, oil which has been scraped from the cylinder wall during operation of the engine. While some incidental cooling is said to be achieved by oil splashing up from the trough against the interior crown surface, sufficient oil could not be obtained from the cylinder wall for cooling a piston of a modern high output diesel engine.

Similarly, the Maybach et al. U.S. Pat. No. 2,759,461 and the Athenstaedt U.S. Pat. No. 3,930,472 disclose a labyrinth of oil-carrying channels and conduits in two-piece pistons. However the design is impractical and complicated and could not be used in a piston having a relatively short piston pin to crown dimension.

The Clary et al. U.S. Pat. No. 3,805,677 discloses a two-piece piston provided with a transverse bridge member spanning the skirt section. The bridge member is of a material having a coefficient of thermal expansion less than that of the material of which the head and skirt portions are formed, in order to restrict the amount of thermal expansion of the skirt, thereby enabling a reduction in the noise generated and in the rate of cavitation erosion. The bridge member also provides the strength required to resist the side thrust loads at the top of the skirt. The bridge member is provided with one or more apertures to enable cooling oil to enter the chamber between the bridge and the central undercrown surface of the head, but there is no peripheral coolant chamber for cooling the peripheral undercrown portion of the head.

The present invention overcomes these disadvantages by providing a generally annular interior oil-carrying cavity adjacent the periphery of the piston crown. The cavity is defined by opposed portions of two integral piston sections thereby simplifying manufacturing techniques and increasing reliability and durability of the assembled unit.

SUMMARY OF THE INVENTION

The present invention provides a two-piece piston including a skirt section having an exposed annular tray adjacent its periphery and a head section having a corresponding undercrown recess. Upon assembly of the skirt and head sections, a generally toroidal cooling cavity is formed within the piston. The skirt may also be formed with a central oil-carrying bridge which communicates at opposite ends with the cooling cavity to convey oil beneath the center of the piston crown. Inlet and exit ports formed in the piston skirt regulate the flow of oil into and out of the tray.

BRIEF DESCRIPTION OF THE DRAWINGS

For a further understanding of the present invention, reference may be had to the accompanying drawings, in which.

DESCRIPTION OF THE PREFERRED EMBODIMENTS

Figure 1:
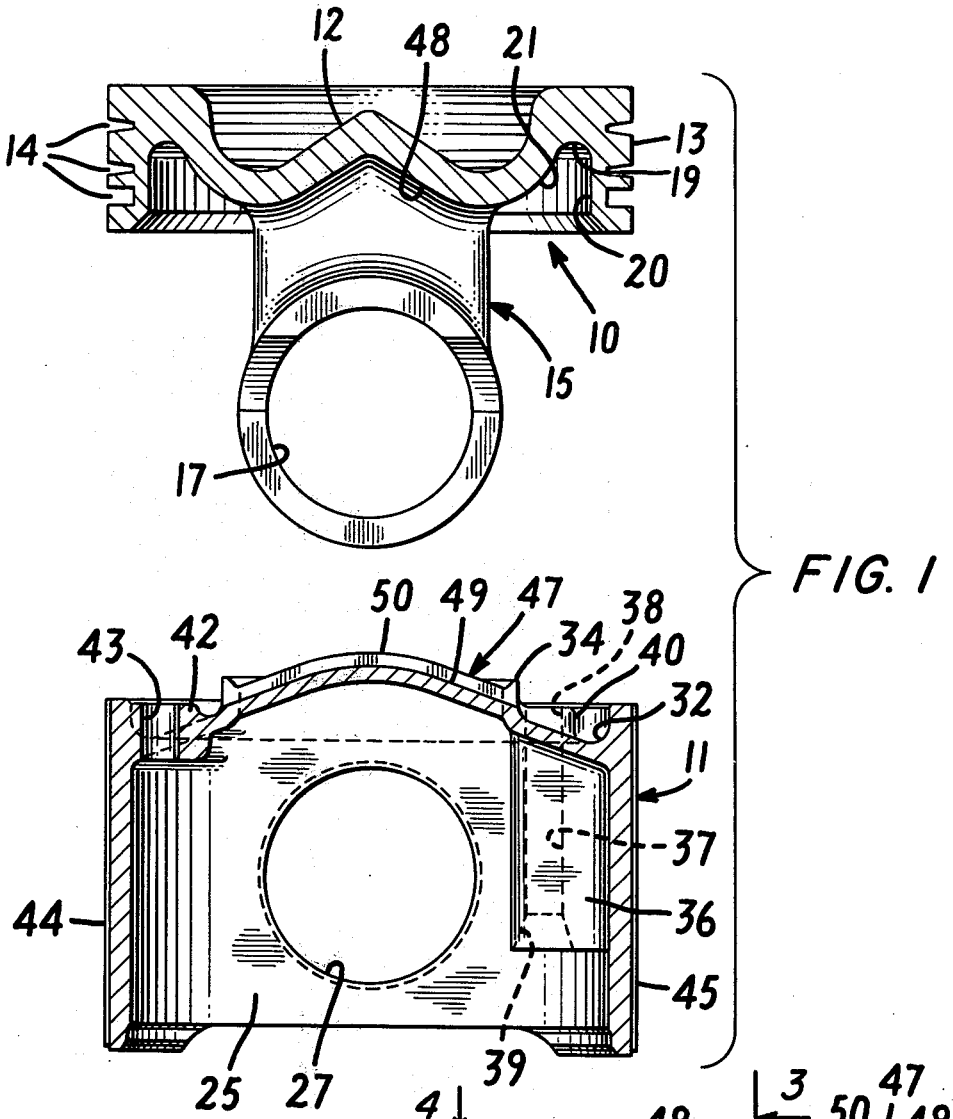
FIG. 1 is an exploded sectional view of the head and skirt sections of a piston according to the invention.

Referring now to FIGS. 1–4, there is shown a piston assembly which includes a head section 10 and a skirt section 11. The head 10 includes a crown 12, which may be of the "Mexican hat" type, for example, and an outer sidewall 13 formed with a plurality of grooves 14 adapted to carry conventional piston rings (not shown). The head 10 is formed with a pair of depending bosses 15 having generally flat exterior lateral abutment surfaces 16. Each of the bosses 15 is formed with a bore 17 for receiving the usual piston pin 18 operatively to interconnect the piston with the usual connecting rod (not shown) in order to reciprocate the piston in the usual cylinder bore (not shown).

The head section 10 is formed with a substantially annular undercrown recess 19 adjacent the crown periphery, the recess 19 being disposed between the sidewall 13 and the outer portion of the crown 12. The sidewall 13 is preferably of substantially constant thickness to obtain uniform cooling of the piston rings, thereby providing a generally vertical inner sidewall surface 20, which with the sloping undersurface 21 of the outer crown portion define the recess 19. The head section 10 is preferably of cast iron and is cast to form a single integral piece.

The skirt section 11 is a hollow partially cylindrical shell having an exterior diameter slightly larger than that of the head section 10 according to conventional practice. The skirt includes diametrically opposed thrust sidewalls 22 and 23 having outer cylindrical surfaces, between which are a pair of opposed generally flat sidewalls 24 and 25. The sidewalls 24 and 25 are formed with bores 26 and 27, respectively, for receiving the piston pin 18. Upon assembly of the head 10 and the skirt 11 with the pin 18, the surfaces 16 of the bosses 15 abut the inner surfaces 28 and 29 of the sidewalls 24 and 25, respectively, and the lower surface of the head sidewall 13 is spaced from the opposed upper peripheral surface of the skirt 11 at 30 to accommodate relative movement between the head and skirt.

Figure 2:
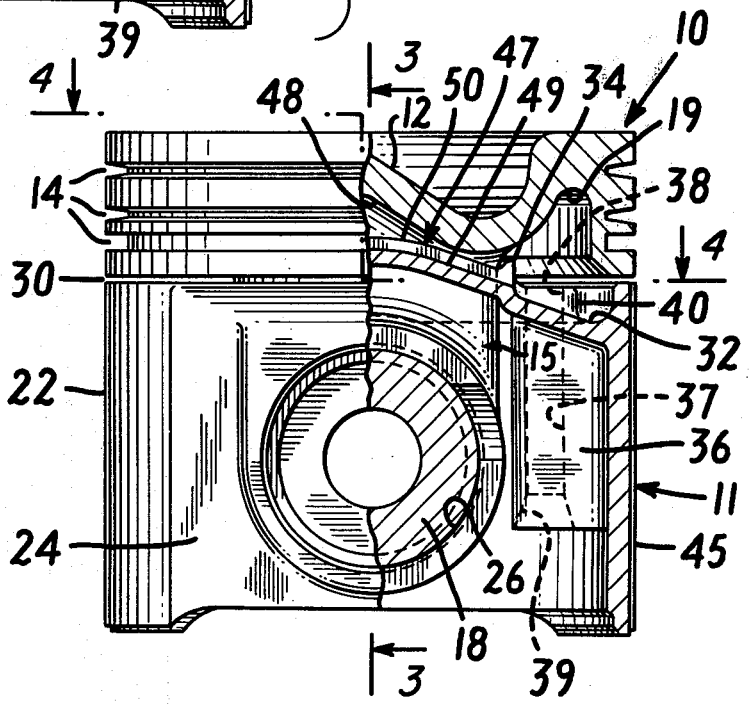
FIG. 2 is an elevational view, partly in section, of the assembled head and skirt sections of FIG. 1.
Figure 3:
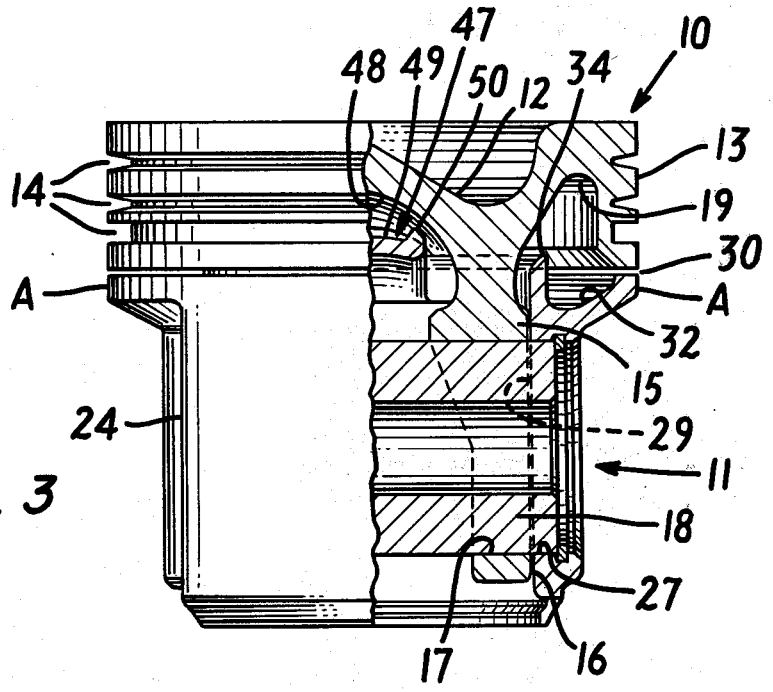
FIG. 3 is a view, partly in section, taken along the line 3—3 of FIG. 2 and looking in the direction of the arrows.
Figure 4:
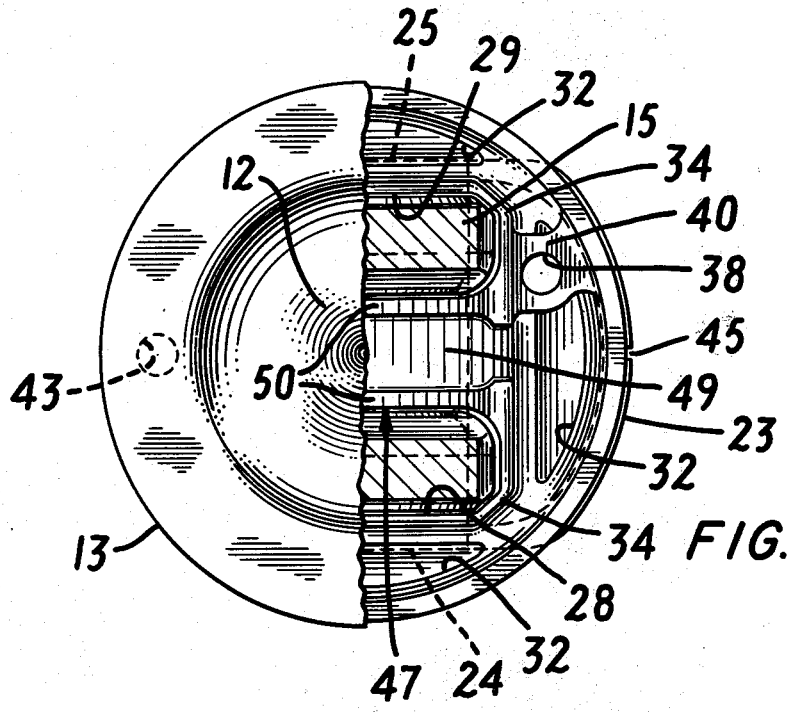
FIG. 4 is a view taken along the line 4—4 of FIG. 2 and looking in the direction of the arrows.

The skirt section 11 is formed with an integral substantially annular tray 32 which is in opposed facing relation to the corresponding undercrown recess 19 formed in the head section 10, the tray 32 extending radially outwardly of the flat sidewalls 24 and 25. Together, the tray 32 and recess 19 define a generally toroidal interior cavity located adjacent the sidewall 13 and the periphery of the crown 12. As shown in FIGS. 2 and 3, the tray 32 has a generally U-shaped cross section, although the actual cross-sectional configuration of the tray may be varied as shown and need not be uniform along the circumference of the piston. The inner wall of the tray 32 is formed by a lip 34 that extends upwardly toward, but is spaced from, the undercrown surface of the head section 10.

The skirt section 11 is formed with a boss 36 that is integral with the sidewall 23 and the tray 32, the boss 36 containing a bore 37 that opens at its upper end into the tray to define an oil inlet port 38. The lower opening 39 of the bore 37 is flared outwardly to facilitate the introduction of cooling oil into the bore from a conventional oil jet (not shown) mounted on the cylinder block (not shown), the oil flowing into the tray 32 from the bore 37 through the inlet port 38. The upper end 40 of the boss 36 is elevated above the bottom of the tray 32 to prevent undesirable drainage of oil from the tray through the bore 37 and interference with the supply of oil therethrough.

Alternatively, the inlet bore 37 could be disposed so as to receive oil from a jet formed in the upper portion of the connecting rod supplied through a passage in the connecting rod that communicates with a passage in the crankshaft, such passages being well known in the art.

An integral boss 42 formed in the tray 32 remote from the bore 37 contains a drain bore 43 for draining oil from the tray into the sump. The boss 42 extends above the bottom of the tray in order that the desired quantity of oil be retained in the tray during operation of the engine.

Alternatively, if the clearance between the lip 34 and the opposed undersurface of the crown 12 enables sufficient spillage to drain the tray 32, the drain bore 43 (and the boss 42) may be omitted.

A pair of vertical relief grooves 44 and 45 are cast into the outer surfaces of the thrust sidewalls 22 and 23, respectively, the relief grooves extending the entire axial length of the thrust sidewalls. Accordingly, oil traveling radially outwardly from the tray 32 toward the cylinder bore through the annular passage defined by the space 30 between the opposed peripheral portions of the head and skirt is drained into the sump through the relief grooves 44 and 45. Drainage of oil traveling through the annular passage 30 to the cylinder bore may be important in order to prevent overloading of the conventional oil control ring (not shown) carried by the lowest of the grooves 14.

Alternatively, the relief grooves 44 and 45 may be spiral rather than linear to avoid any undue wear of the cylinder wall.

In another alternative, the oil traveling radially outwardly through the annular passage 30 may be drained through at least one space between the cylinder bore and a relieved or cut back portion of the external cylindrical skirt surface adjacent the head sidewall 13 and above one of the flat skirt sidewalls 24 and 25. Preferably such drainage would be accomplished past two diametrically opposed relieved portions at "A", the location of maximum relief being generally in a vertical plane passing through the axis of the pin 18.

In still another alternative, oil traveling radially outwardly could be drained by the relief grooves 44 and 45 together with one or more relieved portions at "A".

The skirt section 11 is formed with an integral transverse bridge 47 interconnecting diametrically opposed portions of the tray 32 for conveying cooling oil from the tray toward the central undercrown surface 48 in order to cool the central portion of the crown 12. To this end, the bridge 47 includes a central longitudinal channel 49 defined by a pair of spaced upwardly extending sidewalls 50. The ends of the bridge 47 open freely into the tray 32, inasmuch as the lip 34 does not extend between the sidewalls 50, so that channel 49 communicates at opposite ends with the continuous peripheral coolant chamber defined by the undercrown recess 19 and the tray 32. The bridge 47 extends between the bosses 15, and the sidewalls 50 are spaced from the adjacent surfaces of the crown 12 and the bosses 15 to accommodate relative movement between the head 10 and the skirt 11 and to drain oil from the central chamber between the bridge 47 and the undercrown surface 48 into the sump.

The skirt section 11 is preferably of an aluminum alloy and is cast to form a single integral piece.

In operation, cooling oil is introduced from the inlet bore 37 into the peripheral chamber defined by the undercrown recess 19 and the tray 32, and is splashed up and down by the normal piston reciprocation in a "cocktail shaker" action. The repeated splashing of the oil against the surfaces 20 and 21 transfers heat from these surfaces to the oil and thus cools the sidewall 13 and the peripheral portion of the crown 12.

Cooling oil also flows from the tray 32 onto the bridge 47 from both ends thereof and repeatedly splashes against the central undercrown surface 48 in a "cocktail shaker" action, thereby extracting heat from the central portion of the crown 12. By cooling the central portion of the crown 12 as well as the periphery thereof, temperature gradients in the piston head 10 are minimized, thus minimizing the thermal load on the piston.

The heated oil is drained into the sump by the drain bore 43, the relief grooves 44 and 45, the spillage between the lip 34 and the opposed undersurface of the crown 12, and the spillage between the bridge sidewalls 50 and the adjacent surfaces of the crown 12 and the bosses 15, while cooling oil is replenished from the inlet bore 37.

The quantity of oil in the tray 32 for the desired "cocktail shaker" action depends upon the size of the inlet bore 37 and the drain bore 43, the height of the bosses 40 and 42 above the bottom of the tray, the shape of the tray, the size of the relief grooves 44 and 45, and the spacing between the lip 34 and the opposed undersurface of the crown 12. The quantity of oil available for cooling the central portion of the crown 12 depends upon the cross-sectional area of the channel 49, the size of the opening into both ends of channel between the bridge 47 and the opposed undersurface of the crown 12, and the spaces between the bridge sidewalls 50 and the adjacent surfaces of the crown and the bosses 15.

Figure 5:
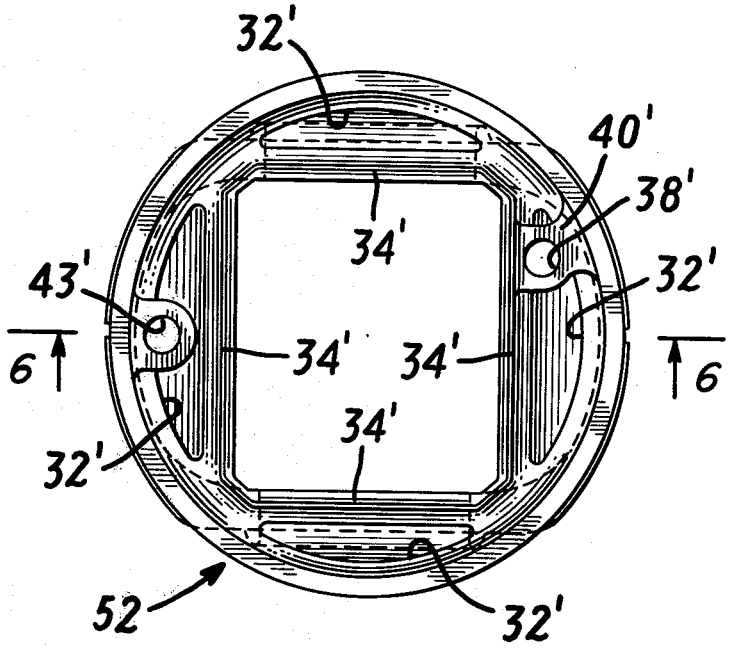
FIG. 5 is a plan view of the skirt section of a piston according to another embodiment of the invention.
Figure 6:
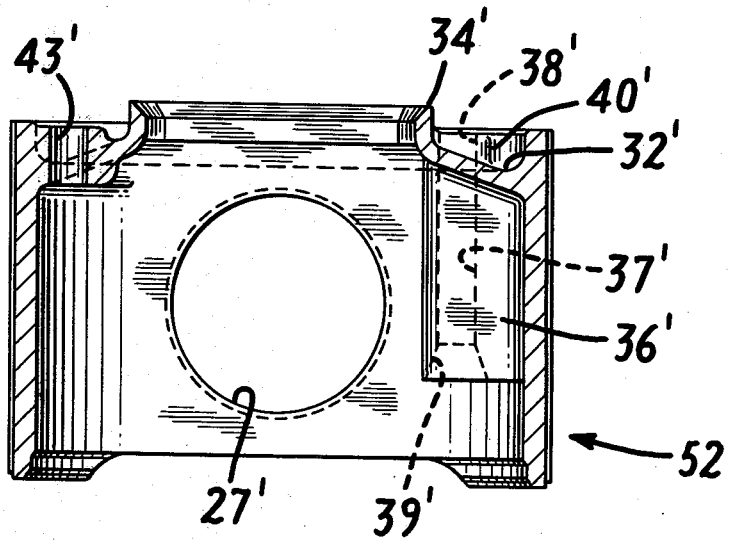
FIG. 6 is a view taken along the line 6—6 of FIG. 5 and looking in the direction of the arrows.

In the embodiment of the invention shown in FIGS. 5 and 6, the "cocktail shaker" cooling chamber is restricted to the periphery of the piston crown, the skirt section 52 being assembled with the head section 10 of FIGS. 1–4. Corresponding elements are designated with the same reference numerals, primes being added to the elements in FIGS. 5 and 6. Skirt 52 differs from skirt 11 in that the former has no transverse bridge interconnecting opposed portions of the tray 32', and so the lip 34' extends around the entire inner boundary of the tray.

A piston according to the embodiment of FIGS. 5 and 6 would be used where a relatively hot central portion of the crown is desired, in order to improve fuel consumption and emission control.

It is to be understood that the above-described embodiments are merely exemplary and are susceptible to modifications, substitutions and variations by those skilled in the art without departing from the spirit and scope of the invention. For example, the entire outer surface of the skirt section could be cylindrical. All such modifications and variations are intended to be within the scope of the invention as defined by the following claims.

I claim:

1. A two-piece piston comprising:

a one-piece integral head section having a crown and depending boss means, said boss means having a bore for receiving a pin, and the head section being formed with an annular undercrown recess adjacent the periphery of the crown; and a one-piece integral skirt section for assembly with the head section, the skirt section having bores corresponding to and coaxial with the bore in the head section when the head and skirt sections are assembled together, and having an annular coolant-carrying tray in opposed spaced relation to the undercrown recess of the head section, so as to form a coolant chamber substantially continuous about the periphery of the piston when the head and skirt sections are assembled together, the tray having an inner wall portion extending toward and spaced from the undercrown surface of the head section to provide a passage for controlling the flow of coolant exiting said tray toward the center portion of said undercrown surface; and said skirt section being formed with at least one passage communicating with the tray for introducing coolant under force into said tray from a reservoir disposed beneath said piston.

2. The piston of claim 1, wherein the skirt section is formed with at least one drain passage communicating with the tray for draining coolant from the tray.

3. The piston of claim 1, wherein the adjacent peripheral portions of the head and skirt sections, when assembled in a cylinder bore, are spaced from each other forming an annular passage enabling draining coolant from the tray radially outwardly therefrom, and wherein at least one portion of the external cylindrical surface of the skirt section is relieved so as to form a passage communicating with the annular passage for draining coolant from the annular passage away from the head section.

4. The piston of claim 3, wherein there are two diametrically opposed relieved portions of the outer skirt section surface disposed generally adjacent the coaxial bores.

5. The piston of claim 3, wherein the relieved portion is a generally axially extending recess formed in the external cylindrical surface of the skirt section.

6. The piston of claim 1, wherein the skirt section is formed with an integral transverse bridge interconnecting diametrically opposed portions of the tray for conveying coolant from the tray toward the central undercrown surface of the head section.

7. A two-piece piston comprising:

a one-piece integral head section having a crown and being formed with an annular undercrown recess adjacent the periphery of the crown;

a one-piece integral skirt section for assembly with the head section having an annular coolant-carrying tray in opposed spaced relation to the undercrown recess of the head section so as to form a coolant chamber substantially continuous about the periphery of the piston when the head and skirt sections are assembled together;

the tray having an inner wall portion extending toward and spaced from the undercrown surface of the head section to provide a passage for controlling the flow of coolant exiting said tray toward the center portion of said undercrown surface;

said skirt section being formed with at least one passage communicating with the tray for introducing coolant under force into said tray from a reservoir disposed beneath said piston; and the skirt section also being formed with an integral transverse bridge interconnecting diametrically opposed portions of the tray for conveying coolant from the tray toward the central undercrown surface of the head section.

8. The piston according to claim 2 wherein said wall portion comprises a lip member cooperating with said tray and said undercrown surface of said head for maintaining coolant within said tray.

9. The piston according to claim 8 wherein the adjacent peripheral portions of the head and skirt sections, when assembled, are spaced from each other forming an annular passage enabling draining coolant from the tray radially outwardly therefrom, and wherein at least one portion of the external cylindrical surface of the skirt section is relieved to form relief grooves communicating with the annular passage for draining coolant from the annular passage away from the head section.

10. The piston according to claim 9 further comprising an inlet boss extending into said tray and defining an inlet port in communication with said inlet passage; an outlet boss extending into said tray but spaced from said inlet boss and defining an outlet port in communication with said drain passage; said lip member further cooperating with said inlet boss and inlet port and said outlet boss and said outlet port for maintaining coolant within said tray.

11. The piston according to claims 2, 8, 9, or 10 wherein the skirt section is formed with an integral transverse bridge interconnecting diametrically opposed portions of the tray for conveying coolant from the tray toward the central undercrown surface of the head section.

12. The piston according to claim 11 wherein said transverse bridge includes a channel member having a channel portion opposed to and facing said undercrown surface of said head, said channel member further including openings at each end in communication with said tray for allowing coolant in said tray to flow into said channel portion.

13. The piston according to claim 12 wherein said openings extend through said lip member.

14. The piston according to claim 13 wherein said channel member further includes parallel side walls extending upwardly toward said undercrown surface of said head to define said channel portion.

15. The piston according to claim 14 wherein said channel member is arcuate in configuration having a convex surface relative to said undercrown surface of said head.

16. A piston member for reciprocal movement in an internal combustion engine to move a crankshaft through a connecting rod comprising:

(a) a head section having a crown and depending boss means for receiving a pin to connect said piston to said connecting rod, said head section being formed with an annular undercrown recess adjacent the periphery of the crown;

(b) a support member being carried by said head section, said support member having an annular coolant-carrying tray in opposed spaced relationship to the undercrown recess of the head section, so as to form a coolant chamber substantially continuous about the periphery of the piston when the head section and support member are assembled together, the tray having an inner wall portion extending toward and spaced from the undercrown surface of the head section to provide passage for a coolant therethrough;

(c) said piston member defining at least one inlet passage with the tray; and (d) a reservoir for coolant and means for forcing coolant from said reservoir through at least said one inlet passage into said tray.

17. The piston member according to claim 16 wherein said piston member further comprises at least one drain passage communicating with said tray for draining coolant from the tray.

18. The piston member according to claim 17 wherein said support member is a skirt section of a two-piece piston with said inlet passage and said drain passage being defined in said skirt section in communication with said tray.

19. The piston member according to claim 18 wherein said head section includes a one-piece integral member having a crown and two depending bosses, each boss having a bore for receiving said common pin, and said skirt section including a one-piece integral chamber for assembly with said head section, said skirt section having a pair of coaxial bores corresponding to and coaxial with the bores in the head section when the head and skirt sections are assembled together.

20. A two-piece piston comprising:

a one-piece integral head section having a crown and depending boss means, said boss means having a bore for receiving a pin, and the head section being formed with an annular undercrown recess adjacent the periphery of the crown;

a one-piece integral skirt section for assembly with the head section, the skirt section having bores corresponding to and coaxial with the bore in the head section when the head and skirt sections are assembled together, and having an annular coolant-carrying tray in opposed spaced relation to the undercrown recess of the head section, so as to form a coolant chamber substantially continuous about the periphery of the piston when the head and skirt sections are assembled together, the tray having an inner lip extending toward and spaced from the undercrown surface of the head section; and adjacent peripheral portions of the head and skirt sections, when assembled in a cylinder bore, are spaced from each other forming an annular passage enabling draining coolant from the tray radially outwardly therefrom, and wherein at least one portion of the external cylindrical surface of the skirt section is relieved so as to form a passage communicating with the annular passage away from the head section.

21. The piston of claim 20 wherein there are two diametrically opposed relieved portions of the outer skirt section surface disposed generally adjacent the coaxial bores.

22. The piston of claim 21 wherein the relieved portion is a generally axially extending recess formed in the external cylindrical surface of the skirt section.

* * * * *

UNITED STATES PATENT OFFICE

CERTIFICATE OF CORRECTION

Patent No. 4,180,027 Dated December 25, 1979

Inventor(s) Joe Newton Taylor

It is certified that error appears in the above-identified patent and that said Letters Patent are hereby corrected as shown below:

Column 7, claim 19, line 40, the word "chamber" should be --member--.

Signed and Sealed this

*Twenty-second* Day of *April 1980*

[SEAL]

*Attest:*

SIDNEY A. DIAMOND

*Attesting Officer*

*Commissioner of Patents and Trademarks*